United States Patent [19]

Uydess

[11] 4,002,001

[45] Jan. 11, 1977

[54] WALL STUD FOR SECURING PLASTERBOARD

[76] Inventor: Samuel B. Uydess, 10 McKenna Place, Mamaroneck, N.Y. 10453

[22] Filed: Feb. 24, 1975

[21] Appl. No.: 552,549

[52] U.S. Cl. ..... 52/731; 52/480

[51] Int. Cl.[2] ..... E04C 3/30; E04B 5/52

[58] Field of Search ..... 52/378, 371, 370, 731, 52/368, 480, 363, 362, 370, 714, 713, 712; 248/223, 221 R, 221 A, 71, 309 R

[56] References Cited

UNITED STATES PATENTS

| | | | |
|---|---|---|---|
| 814,134 | 3/1906 | Hood | 52/714 |
| 1,559,749 | 11/1925 | Hall | 52/378 |
| 1,676,535 | 7/1928 | Estill et al. | 52/714 |
| 1,726,496 | 8/1929 | Kinninger | 52/370 |
| 1,758,150 | 5/1930 | Elston | 52/373 |
| 1,877,898 | 9/1932 | Kotrbaty | 52/370 |
| 1,934,760 | 11/1933 | Awbrey | 52/714 |
| 2,303,544 | 12/1942 | Goss | 52/714 |
| 2,309,420 | 1/1943 | Taylor | 52/351 |
| 2,400,807 | 5/1946 | Burkhard | 248/223 |
| 3,282,005 | 11/1966 | Birdwell | 52/731 |
| 3,494,090 | 2/1970 | Allen | 52/713 |
| 3,748,815 | 7/1973 | Parker | 52/714 |
| 3,750,360 | 8/1973 | Kingston | 52/714 |
| 3,817,394 | 6/1974 | Saiki | 248/221 |

*Primary Examiner*—Price C. Faw, Jr.
*Assistant Examiner*—Robert C. Farber
*Attorney, Agent, or Firm*—Friedman, Goodman & Teitelbaum

[57] ABSTRACT

A wall stud for securing plasterboard to masonry, bricks, blocks and the like, the wall stud comprising a box-like member for receiving fasteners which secure the plasterboard thereto. The box-like member includes inner and outer walls and sidewalls connected together to define the box-like member. The plasterboard is secured against the outer wall in a parallel arrangement therewith. The box-like member is provided with a perpendicularly extending anchor member adapted to be disposed in mortar joints connecting the masonry, bricks, blocks and the like to secure the inner wall there against. The anchor member includes a body portion having an end which is remote from the inner wall. An open area is disposed between the inner wall and the remote end so that mortar can be received therethrough to anchor the remote end when the mortar is hardened. In one embodiment, the anchor member comprises a bent-out tab provided with a punched-out hole therein. In another embodiment, the anchor member comprises a U-shaped wire-like member which encloses an open area.

2 Claims, 8 Drawing Figures

FIG.2

WALL STUD FOR SECURING PLASTERBOARD

BACKGROUND OF THE INVENTION

The present invention relates to a wall stud, and more particularly to a wall stud for securing plasterboard to masonry, brick, blocks and the like.

At present, it is a difficult time-consuming and relatively costly operation to apply a plasterboard to a wall formed from masonry, bricks, blocks and the like.

Considerable quantities of masonry, bricks and blocks are used in forming basements or foundation walls of residences and other buildings. The general practice at the present time to improve the appearance of such walls, is to nail or otherwise secure furring strips of wood to the wall after the wall has been laid, and to then apply a plasterboard to the furring strips by conventional means such as nails, screws, etc.

In some instances, metallic furring brackets have been used to replace the above-mentioned wood furring strips. These furring brackets are positioned between the adjacent ends of a pair of blocks or masonry units as the masonry units are being laid. The furring brackets extend beyond the inner surfaces or walls of the blocks or units to function as a base for the quick attachment thereto of metallic lathing, composition panels or other interior wall furnishing materials. Tang portions of these furring brackets hook onto the back of the blocks or units. The brackets also serve to space the finished wall structure from the masonry wall. However, if an outward force is exerted on the finished wall structure, such as a force exerted from a shelf mounted on the finished wall structure, it is possible to unhook the furring brackets and pull the finished wall structure away from the masonry wall.

SUMMARY OF THE INVENTION

This invention relates to a wall stud for securing plasterboard to masonry, bricks, blocks and the like, the wall stud comprising box-like means for receiving fasteners which the plasterboard to the box-like means. The box-like means includes inner and outer walls and sidewalls connected together to define a box-like member, the plasterboard being secured against the outer wall in a parallel arrangement therewith. The box-like member is provided with anchoring means adapted to be disposed in mortar joints connecting the masonry, bricks, blocks and the like to secure the inner wall against the masonry, bricks, blocks and the like. The anchoring means are movable to a position perpendicular to the inner wall to extend away from the inner wall, the anchoring means including a body member having an end portion which is remote from the inner wall in a perpendicular direction, and open means disposed between the wall and the remote end portion in the perpendicular position to receive mortar therethrough to anchor the remote end portion when the mortar is hardened. In one embodiment, the anchoring means comprises a bent-out tab, and the open means includes a punched-out opening in the tab. In another embodiment, the anchoring means comprises a U-shaped wire-like member, where the opening means is defined by the open area enclosed by the U-shaped member. Preferably, the bight of the U-shaped member is provided with turns thereon.

Accordingly, an object of the present invention is to provide a wall stud which overcomes the disadvantages of the prior art.

Another object of this invention is to provide a wall stud with at least one tab member having a punched-out hole therein for securing plasterboard to masonry, bricks, blocks and the like.

A further object of this invention is to provide a wall stud having a U-shaped wire-like member for securing plasterboard to masonry, bricks, blocks and the like.

A still further object of the present invention is to provide a wall stud that is easily applied to masonry, bricks, blocks and the like, and to which plasterboards can be easily secured.

Yet another object of the present invention is to provide a wall stud that is simple and inexpensive to manufacture, one which has few parts and cannot be easily damaged.

An added object of this invention is to provide a wall stud upon which a plasterboard can be mounted in a flush arrangement.

And yet another added object of this invention is to provide a wall stud which serves to space the plasterboard from the masonry, bricks, blocks and the like to increase the insulating value thereof.

BRIEF DESCRIPTION OF THE DRAWINGS

With the above and additional objects and advantages in view, as will hereinafter appear, this invention comprises the devices, combinations and arrangements of parts hereinafter described by way of example and illustrated in the accompanying drawings of preferred embodiments in which.

DESCRIPTION OF THE PREFERRED EMBODIMENT

Figure 1:
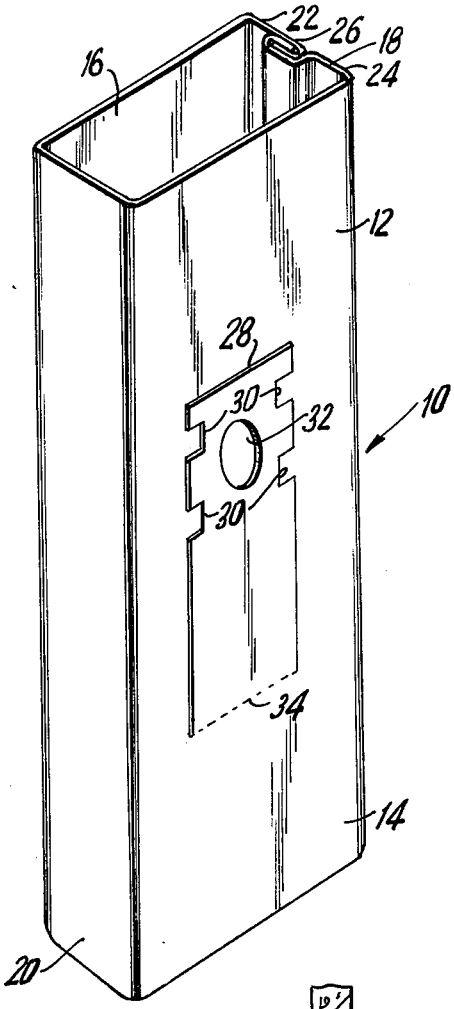
FIG. 1 represents a perspective view of a wall stud pursuant to the present invention, showing the wall stud prior to its positioning arrangement.
Figure 2:
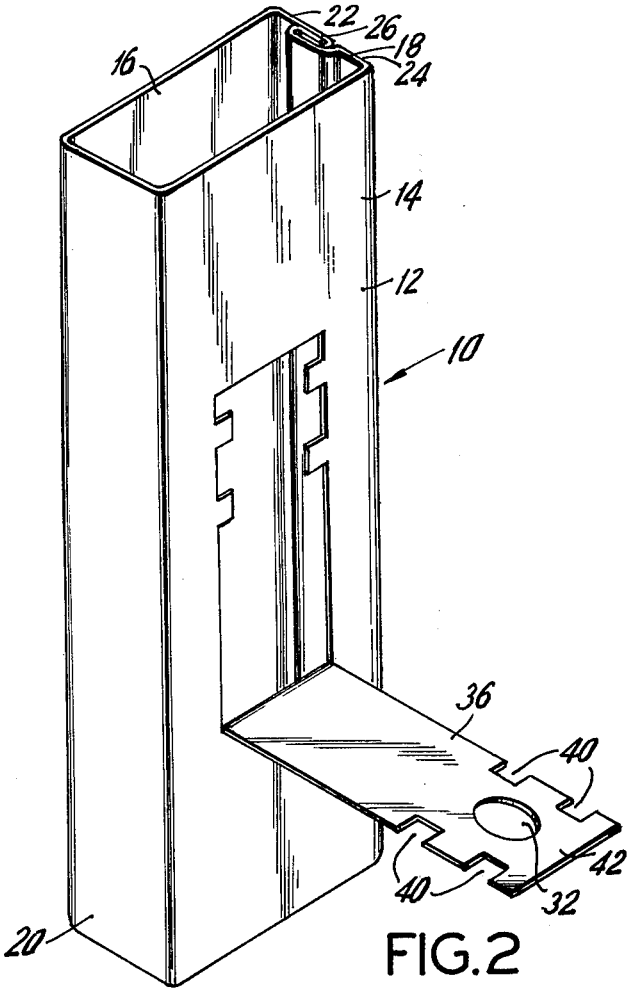
FIG. 2 represents a perspective view of the wall stud in its positioning arrangement.

Referring to the drawings, FIG. 1 illustrates a wall stud 10 of the present invention. The wall stud 10 as positioned in FIG. 2, is applied to a wall which is being erected of masonry, bricks or blocks, as will be set forth hereinafter below in more detail.

Figure 3:
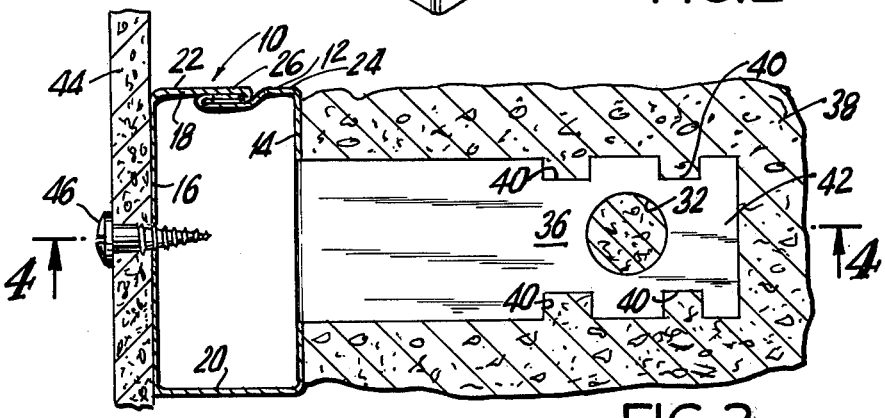
FIG. 3 represents a sectional view, taken on the line 3—3 of FIG. 4, showing the wall stud disposed in a wall.

The wall stud 10 includes a box-like body member 12 having an inner wall 14 and an outer wall 16 substantially parallel to the inner wall 14. Substantially parallel spaced-apart sidewalls 18 and 20 are perpendicular to the inner and outer walls 14, 16 respectively, and are disposed therebetween to connect the edges of the inner wall 14 to the edges of the outer wall 16 to define an open-end hollow box. Preferably, the inner and outer walls 14, 16 are wider than the sidewalls 18, 20 to define a rectangular configuration in cross-section, as shown in FIG. 3. However, the wall members may be of the same width to define a square in cross-section, or these widths may be varied as desired for any particular suitable arrangement thereof. Additionally, the wall members 14, 16, 18 and 20 may be formed in any desired suitable length, defined by the longitudinal distance between the opposite ends.

The box-like member 12 is formed from sheet metal, being bent into the box-like shape. However, it is understood that the box-like member 12 may also be formed from a one-piece hollow tubular member or any other suitable material. The sheet metal is cut and bent so that the sidewall 18 is formed from two pieces 22 and 24, which are overlapped at 26. The overlapped 26 may be secured together in any conventional manner, such as soldering, welding or the like. Preferably, the wall stud 10 is fabricated from a relatively heavy gauge sheet metal or tubing or similar material, which is galvanized or otherwise protected against oxidation.

As inverted, substantially U-shaped cut 28 is made through a centrally located portion of the inner wall member 14. The cut 28 may be made in any conventional manner to pierce through the metal of the wall member 14. It is noted, that the legs of the U-shaped cut 28 are stepped or cut irregularly at locations 30 disposed adjacent to the base or bight of the U-shaped cut 28, the purpose of which will be set forth in more detail hereinafter below. Additionally, a circular opening or hole 32 is cut or punched out of the portion of the wall member 14 enclosed by the U-shaped cut 28, the function of which will also be disclosed hereinafter below.

Preferably, the wall member 14 is scored at 34, between the ends of the legs of the U-shaped cut 28, to permit the enclosed portion to be bent out of the box-like member 12 to provide a projection or tab member 36. The hole 32 serves as an aid for bending or pivoting the tab member 36 away from the wall member 14, where a person's finger, a screwdriver or the like may be inserted into the hole 32 to pull or force the tab member 36 in an outward direction. The tab member 36 is bent outwardly to a substantially perpendicular position relative to the wall members 14 and 16, as shown in FIG. 2. In this position, the wall stud is ready to be applied to the wall which is being elected.

Figure 4:
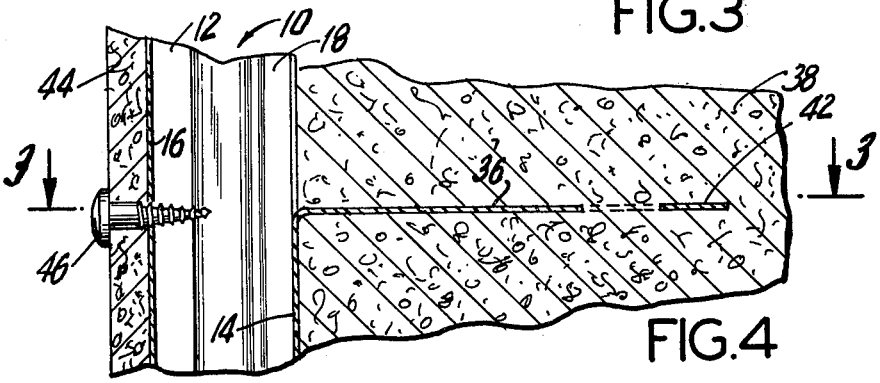
FIG. 4 represents a sectional view, taken on the line 4—4 of FIG. 3.

The bent-out tab member 36 is placed horizontally into the mortar or cement joints 38 which secure the masonry, bricks or blocks together. The box-like member 12 is vertically positioned flush with the wall and snug thereto. The recesses or cutouts 40, formed in the tab member 36 by the stepped cuts 30, provide a solid anchor within the mortar joints 38, when the mortar joints 38 have hardened. Additionally, as shown in FIGS. 3 and 4, the hole 32 also serves to anchor the tab member 36 within the hardened mortar joint 38, wherein the tip or free end portion 42 cannot be pulled free from the hardened mortar joint 38 due to the presence of the hardened mortar between the tip portion 42 and the box-like member 12.

After the wall stud has been anchored to the wall, a conventional pre-cut plasterboard section 44 or the like is disposed against the outer wall member 16. Conventional sheet metal screws 46, or other such securing devices, are driven through the plasterboard section 44 into the box-like member 12 to secure the plasterboard section 44 to the wall stud 10, and thereby secure the plasterboard section 44 relative to the wall. It is further noted, that this arrangement provides an air space between the plasterboard sections 44 and the wall, such air space being desired for its extra insulating value.

Figure 5:
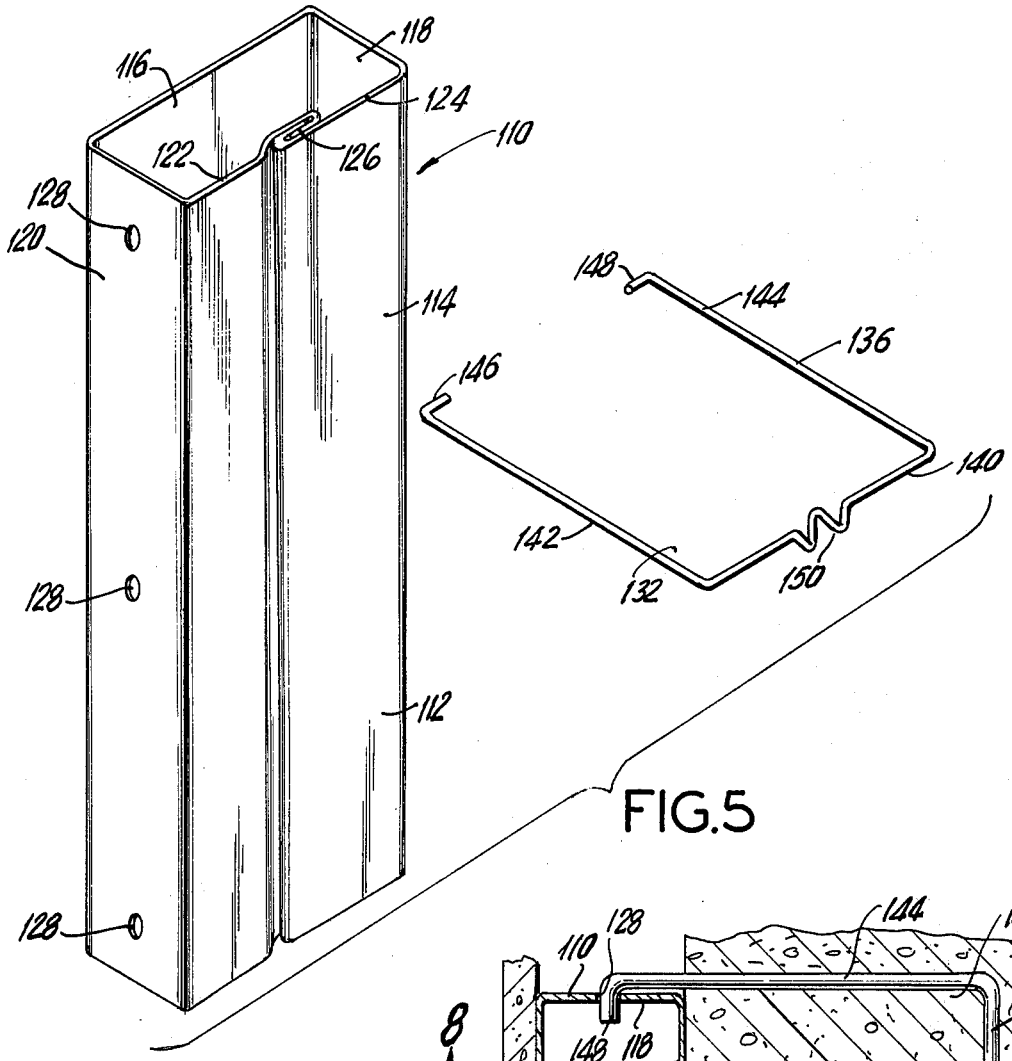
FIG. 5 represents an exploded perspective view of a modified wall stud pursuant to the present invention, showing the wall stud prior to assembly thereof.

FIG. 5 illustrates a modified embodiment of the present invention showing a wall stud 110 which is applied to a wall being erected of masonry, bricks or blocks as mentioned above. The wall stud 110 is similar to the above mentioned wall stud 10, however, the wall stud 110 is formed from two separate members, as set forth hereinafter below in more detail.

Figure 6:
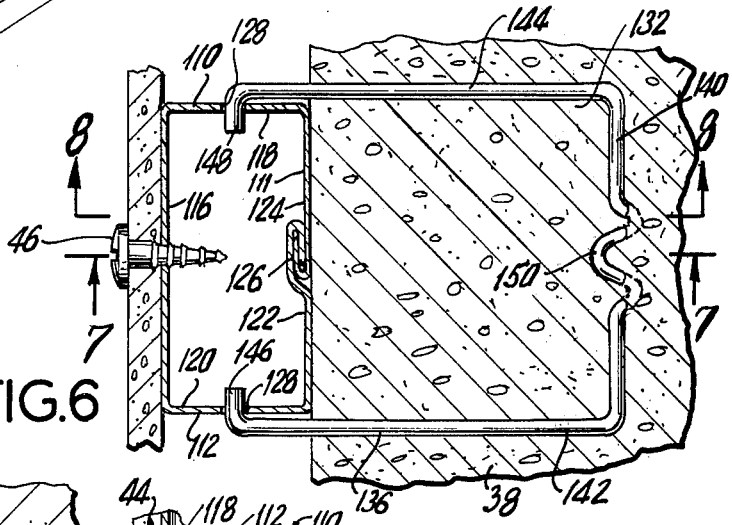
FIG. 6 represents a sectional view of the modified wall stud, showing the modified wall stud disposed in a wall.

The wall stud 110 includes a box-like body member 112 having an inner wall 114 and an outer wall 116 substantially parallel to the inner wall 114. Substantially parallel spaced-apart sidewalls 118 and 120 are perpendicular to the inner and outer walls 114, 116 respectively, and are disposed therebetween to connect the edges of the inner wall 114 to the edges of the outer wall 116 to define an open end hollow box. Preferably, the inner and outer walls 114, 116 are wider than the sidewalls 118, 120 to define a rectangular configuration in cross-section as shown in FIG. 6. However, as mentioned above, the wall members may be of the same width to define a square in cross-section, all these widths may be varied as desired for any particular suitable arrangement thereof. Additionally, the wall members may be formed in any desired, suitable length, defined by the longitudinal distance between the opposite open ends.

The box-like member 112 is formed from sheet metal, being bent into the box-like shape. However, as mentioned above, it is understood that the box-like member 112 may also be formed from a one-piece hollow tubular member or any other suitable material. The sheet metal material is cut and bent so that the inner wall member 114 is formed from two end pieces 122 and 124, which are overlapped at 126. As mentioned above, the overlapped 126 may be secured together in any conventional manner, such as soldering, welding or the like. Preferably, the wall stud 110 is fabricated from a relatively heavy gauge sheet metal or tubing or similar material, which is galvanized or otherwise protected against oxidation.

A series of apertures, openings or holes 128 are formed in both sidewalls 118 and 120. Each hole 128 in one of the sidewalls is in axial alignment with a corresponding hole 128 in the opposite sidewall to define a pair of associated holes 128, as best shown in FIG. 6.

Figure 7:
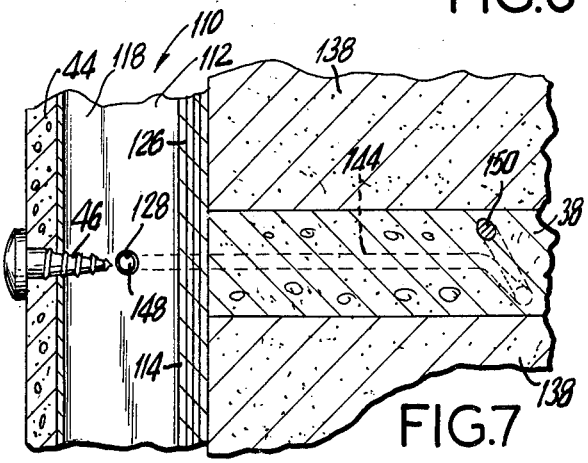
FIG. 7 represents a sectional view, taken on the line 7—7 of FIG. 6.
Figure 8:
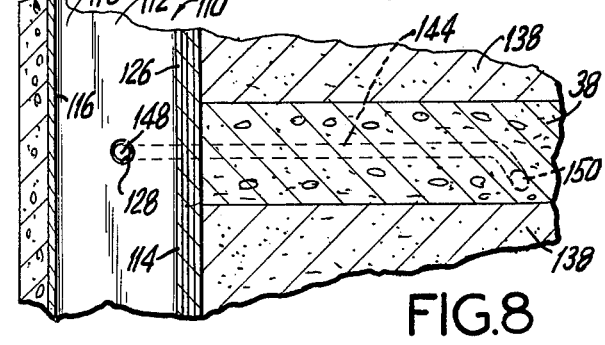
FIG. 8 represents a sectional view, taken on the line 8—8 of FIG. 6.

In this modified embodiment, the tab member 36 of the wall stud 10 is replaced by a substantially U-shaped wire-like member 136 having a bight 140 and leg members 142 and 144. The U-shaped member 136 preferably has a circular cross-section and may be formed from steel, extruded aluminum, plastic or any other suitable material. The leg members 142, 144 are each provided with inwardly extending projections or tabs 146 and 148 respectively. The tabs 146 and 148 are sized slightly smaller than the holes 128 to be easily inserted into the holes 128, as best shown in FIG. 6. Accordingly, the tabs 146, 148 can be inserted in any one of the associated pairs of holes 128, with the leg members 142, 144 being disposed adjacent the outer surfaces of the sidewalls 120, 118 respectively. In this arrangement, the legs 142, 144 are positioned perpendicular to the inner and outer wall members 114, 116 as indicated in FIGS. 7 and 8.

Additionally, the bight 140 is preferably formed with an irregular configuration 150, such as turns centrally located therein, or detents or other similar variations. The function of the turns 150 will be set forth hereinafter below. It is noted, that the U-shaped member 136 defines an enclosed area 132, which also will be mentioned below.

After the U-shaped member 136 has been joined to the box-like member 112, in the manner mentioned above, the U-shaped member 136 is placed horizontally into the mortar or cement joints which secure the masonry, bricks or blocks 138 together. The box-like member 112 is vertically positioned flush with the wall or brick line and snug thereto, as shown in FIGS. 6, 7 and 8. The open area 132 serves to anchor the U-shaped member 136 within the hardened mortar joint 38, wherein the bight 140 or free end portion cannot be pulled from the hardened mortar joints 38 due to the presence of the hardened mortar between the bight 140 and the box-like member 112. Additionally, the turns 150 on the bight 140 provides additional anchoring means by having portions disposed in the hardened mortar 38 above and below the leg members 142 and 144, as best shown in FIGS. 7 and 8.

After the wall stud 110 has been anchored to the wall, a conventional pre-cut plasterboard section 44 or the like is disposed against the outer wall member 116, in the same manner as mentioned above. Here again, conventional sheet metal screws 46, or other such securing devices, are driven through the plasterboard section 44 into the box-like member 112 to secure the plasterboard section 44 to the wall stud 110, and thereby secure the plasterboard section 44 relative to the wall. It is still further noted, that this arrangement also provides for the above-mentioned air space between the plasterboard sections 44 and the wall to obtain the extra insulating value.

Numerous alterations of the structures herein disclosed will suggest themselves to those skilled in the art. However, it is to be understood that the present disclosure relates to preferred embodiments of the invention which are for purposes of illustration only and not to be construed as limitations of the invention.

What is claimed is:

1. A wall stud for securing plasterboard to masonry, bricks, blocks and the like, said wall stud comprising box-like means for receiving fasteners which secure the plasterboard to said box-like means, said box-like means including first, second, third and fourth walls connected in sequence to define a box-like member, said first wall being adapted to be secured against the plasterboard in a parallel arrangement therewith, said box-like member being provided with anchoring means adapted to be disposed in mortar joints connecting the masonry, bricks, blocks and the like to secure said third wall against the masonry, bricks, blocks and the like, said anchoring means being movable to a position perpendicular to said third wall to extend away from said third wall, said anchoring means including a bent-out tab member having an attached portion connected to said third wall and an end portion which is remote from said third wall in the perpendicular position, open means for permitting insertion therethrough for forcing said remote end portion of said tab member out and away from said third wall to said perpendicular position, said open means being disposed in said tab member between said attached portion and said remote end portion to receive mortar therethrough when in said perpendicular position to anchor said remote end portion when the mortar is hardened, said open means including a circular hole extending through said tab member and recesses provided in edge portions of said tab member, said recesses being disposed on opposite sides of said circular hole.

2. A wall stud according to claim 1, wherein said box-like member is fabricated from sheet metal and has a longitudinal overlap seam in one of said first, second and fourth walls.

* * * * *